United States Patent [19]

Groza et al.

[11] 4,368,614

[45] Jan. 18, 1983

[54] VERTICAL WIRE-ROPE TWISTING MACHINE

[76] Inventors: Viktor F. Groza, ulitsa Darvina, 7, kv. 12, Kharkov; Khristofor S. Shakhpazov, prospekt Mira, 188, kv. 30, Moscow; Nikolai P. Shtykh, ulitsa III Internatsionala, 17, kv. 56, Kharkov; Ivan N. Nedovizy, ulitsa Moskovskaya, 37, kv. 49, Magnitogorsk; Nikolai I. Drozdov, prospekt Vernadskogo, 82, kv. 1517, Moscow; Sergei F. Korovainy, ulitsa Vokzalnaya, 70, kv. 29, Khartsyzsk, Donetskaya oblast; Nikolai P. Chernenko, ulitsa Pushkinskaya, 18, kv. 4; Vitaly S. Starchenko, Moskovskoe shosse, 157, kv. 12, both of Orel; Jury I. Chernichenko, ulitsa Bljukhera, 7, kv. 161, Kharkov; Ljudmila P. Lebed, ulitsa Geroev Truda, 26, kv. 65, Kharkov; Ljubov F. Musolova, prospekt 50 let Vlksm, 44-a, kv. 168, Kharkov; Vladimir F. Mischikha, Yasny proezd, 30, korpus 1, kv. 47, Moscow; Sergei D. Psarev, prospekt Metallurgov, 32, kv. 32, Orel; Stanislav A. Ropakov, prospekt Lenina, 64, kv. 236; Igor G. Mirensky, Kirgizsky proezd, 1, kv. 16, both of Kharkov, all of U.S.S.R.

[21] Appl. No.: 245,393

[22] Filed: Mar. 19, 1981

[51] Int. Cl.[3] ..... D07B 3/04; D07B 3/12; D07B 7/02

[52] U.S. Cl. ..... 57/58.52; 57/58.34; 57/58.36; 57/58.76

[58] Field of Search ..... 57/58.3, 58.32, 58.34, 57/58.36, 58.52, 58.72, 58.76, 58.83

[56] References Cited

U.S. PATENT DOCUMENTS

| | | | |
|---|---|---|---|
| 2,464,860 | 3/1949 | Green | 57/58.52 |
| 3,785,139 | 1/1974 | Groza et al. | 57/58.34 |
| 4,300,339 | 11/1981 | Orlandi et al. | 57/58.34 |

FOREIGN PATENT DOCUMENTS

| | | | |
|---|---|---|---|
| 1085133 | 9/1967 | United Kingdom | 57/58.52 |

*Primary Examiner*—Donald Watkins
*Attorney, Agent, or Firm*—Lilling & Greenspan

[57] ABSTRACT

A wire-rope twisting machine comprising a rotor mounted in supports secured to a carrying plate, the rotor having a vertically disposed axis of rotation and accommodating journaled in bearings, a spool holder of magnetic material and spools provided with braking means and a wire being twisted, and a spool holder fixing means in the form of an electromagnet. The rotor is fashioned as at least two interconnected end plates journaled in bearings, one of the end plates being the driving plate. The spool holder is made common for all the spools, the axis of rotation thereof essentially coinciding with the axis of rotation of the rotor.

5 Claims, 10 Drawing Figures

VERTICAL WIRE-ROPE TWISTING MACHINE

FIELD OF THE INVENTION

The present invention relates to the art of wire-rope manufacture and, more particularly, to vertical wire-rope twisting machines.

The invention can find most advantageous and effective application for twisting the strands of metal cord or closing together wire-rope cordage of simple construction.

Known in the art are numerous wire-rope twisting machines of various designs. A common disadvantage of these machines is that they tend to occupy large production floor areas.

DESCRIPTION OF THE PRIOR ART

One prior art machine (cf. U.S. Pat. No. 3,785,139) comprises a hollow rotor of non-magnetic material mounted on a frame in two bearing supports disposed adjacent to the end plates of the rotor, reel or spool holders of a magnetic material having spools accommodated inside the rotor in the bearing supports, and spool holder fixing means in the form of electromagnets secured to the frame on the opposite sides of the spool holders.

Fixing the spool holders by a magnetic field permits combining the center of gravity of every spool holder employed with the geometrical axis of the rotor to thereby prevent failures usually taking place in machine provided with a gravitational spool holder, fixing means in case of jamming of one of said spool holders and capture of the latter by the rotating rotor. Also, the electromagnetic spool holder fixing means allowed to mount the rotor vertically, which resulted in a material reduction of the production floor areas occupied by the machines and floorage serviced by any single operator, as well as led to an increased productivity.

Prior to operation, the machine is loaded and threaded with wire to be twisted. From an upper reel located outside the rotor on the carrying plate the wire is passed through a die positioned axially of the rotor to enter the outer shell of the rotor, wherealong it further passes down to a distributing disc. The wire of the spools is caused to pass through the dies disposed axially of the rotor to enter the outer shell of the rotor and pass further downwards to the distributing disc. Each wire is caused to pass along the outer shell of the rotor to enter the distributing disc and exit therefrom at an angle of 120°, wherefrom it is then received by a forming die. The wire take-up mechanism of the machine acts to draw the wires from the spools via the distributing disc and the forming die. The rotating rotor and the distributing disc thereof make it possible for the forming die to effect twisting the wire into a strand or rope, whereupon the thus formed rope is caused to be wound on a take up reel as a finished product. The production process also includes a step of obtaining a dead end product.

Among disadvantages inherent in the above described machine are, firstly, large overall dimensions thereof due to the fact that the total rotor length is not reduced as compared to that of the prior art machines wherein a gravitational system of fixing the spool holders is employed, which in turn complicates a vertical arrangement of the machine; and, secondly, excessive rotor weight and complicated techniques used for the manufacture and maintenance caused by the use of a non-ferrous material, such as fiber-glass plastic, which is generally never employed in machines for wire-rope twisting. In addition, the rotor's moment of inertia in the heretofore described machine is still considerable owing to excessive weight thereof.

Also known is a wire-rope twisting machine, the rotor of which has the form of a shaft mounted in a bearing support and provided with holes or bores to pass wire to be twisted therethrough; secured to the pintles of the shaft are two cylindrical shells, each comprised of a pair of cylindrical rings interconnected by three vertical connecting elements, the elements constituting part of the cylindrical shell, the width of the elements amounting to one fifth of the outer diameter of the shell. The shell is therefore provided with three apertures arranged along the cylindrical surface thereof which, in contrast to the other prior art machines, reduces the weight and the moment of inertia of the shell along with a certain reduction in the length of the rotor. Positioned essentially midway of the rotor shell are massive spool holders, each of the spool holders secured by one side thereof in the bearing support at the pintles of the shaft, the other side being journaled in a bearing support located in the end plate of the rotor. The spool holder fixing system is fashioned as a pair of electromagnets mounted on a base plate symmetrically on both sides of the spool holders. The width and height of the rotor shell exceed two times those of the pole piece of the electromagnet and the spool holder, while the cross-sectional width of the shell connecting element received in a gap between the pole pieces of the electromagnet and the spool holder is three times less than the width of the pole piece of the electromagnet and the spool holder. If the rotor is manufactured from a magnetic material, the above factor acts to weaken the screening effect produced by the rotor shell by virtue of the prevalent conductivity of the air gap between the pole pieces of the electromagnet and the spool holder over the conductivity between the pole piece of the electromagnet and the connecting element of the rotor; otherwise stated, the rotor shell does not prevent the passage of the lines of magnetic flux from the pole pieces of the electromagnet through the spool holder, which provides the magnetic fixation of the spool holder. Also, the connecting elements of the rotor shell are arranged at intervals of 120°, which makes it possible for the gap between the pole pieces of the electromagnet and the spool holder to receive only one connecting element of the shell of the rotor during rotational movement thereof.

Prior to operation, the machine is loaded and threaded with a wire to be twisted. From an upper reel located outside the rotor the wire is passed through a die positioned axially of the rotor to enter the outer portion of the connecting element of the upper shell of the rotor to thereafter pass downwards and further pass through a drilling or bore in the shaft to exit on the opposite side and enter the outer portion of the connecting element of the lower shell of the rotor and be threaded further down through a distributing disc into a forming die. The wire wound on the spool located in the upper shell of the rotor is threaded through a second drilling in the rotor shaft to exit therefrom at the outer portion of the connecting element of the lower shell of the rotor and pass further down through the distributing disc into the forming die. From the spool located in the lower shell of the rotor the wire is threaded through the die positioned axially of the rotor to pass through the distributing disc into the forming die. Each thread of wire passes along the connecting elements of the upper and lower shells of the rotor to enter the distributing disc and the forming die at a spaced relationship of 120°. In the course of the rotational movement of the rotor the take-up mechanism acts to draw the wire from each spool along the thread paths through the forming die wherein twisting or closing is effected. The thus twisted or closed rope is then received by a take up reel as the end product; the production process also includes the step of obtaining a dead end product.

The heretofore described machine suffers from a disadvantage in that wire threading is too complicated, resulting in the wire tending to break in the course of twisting. Besides, the machine requires a separate electromagnetic system to be installed on each spool holder to be electromagnetically fixed, which makes the machine more expensive to manufacture.

The above construction further requires fabrication of expensive rotor shells, and the provision of large windows or apertures therein results in much metal being wasted. Other difficulties are encountered when the machine is to be provided with a fourth spool for the manufacture of a four-strand rope, or structurally less complicated metal cordage with wire strands of larger diameter, viz. between 0.18 and 0.38 mm. In addition, with steel end plates secured to the shell of the rotor the moment of inertia thereof remains still considerable which almost for certain will require the use of additional brakes for braking the rotor after other units of the machine have been stopped to provide for the rotor to stop simultaneously with the rest of the machine, which in the end impairs the quality of rope or metal cordage being twisted.

It is to be noted, however, that the machine of the above construction is rather efficient when used exclusively for twisting the strands of a metal cordage, the industrial demand for which grows much faster than supply offered by the wire-rope manufactures.

SUMMARY OF THE INVENTION

It is a major object of the present invention to provide a vertical wire-rope twisting machine having a single spool holder common for all the spools and a single electromagnetic system for fixing said spool holder.

Another object of the invention is to provide for double-twisting of wire for each revolution of the rotor.

Another object of the invention is to reduce the mass and moment of inertia of the rotor and improve the noise performance thereof.

Another object of the invention is to reduce the overall dimensions of the machine, such as height thereof.

Among other objects is to provide a spool holder the axis of which would be aligned with the geometrical rotational axis of the rotor.

These and other objects are attained by a vertical wire-rope twisting machine comprising a rotor having a vertical axis of rotation and mounted in supports secured to a carrying plate, the rotor accommodating a spool holder of a magnetic material journaled in bearings and spools provided with braking means and wire to be twisted; and a spool holder fixing means in the form of an electromagnet. According to the invention, the rotor is fashioned as at least two interconnected end plates journaled in bearings, one of the end plates being the driving end plate. The spool holder is made common for all the spools, the axis of rotation thereof essentially coinciding with the axis of rotation of the rotor.

Preferably, the end plates are interconnected by tubular elements having at the surface thereof inlet and outlet openings for passing therethrough the wire to be twisted and rotatably secured at a median point thereof by an intermediate support affixed to the carrying plate of the machine.

Alternatively, the end plates may be interconnected by toothed pulleys disposed axially relative to the end plates and enclosed by endless belts adapted to cooperate with a shaft located sideways of and essentially parallel with the rotor.

Preferably, the spool holder of the machine has the form of a space frame with the spools arranged in one row, the braking means thereof incorporating rollers and a space lever.

Alternatively, the spools may be accommodated in the space frame spool holder in two rows essentially in symmetry with the axis of the end plates (see FIG. 3). The braking means of the spools include inserts of semicylindrical shape secured to the spool holder and fabricated from a material having a friction coefficient capable of providing a preset tension of the wire to be twisted.

The essence of the present invention resides in the following.

As is known, in twisting or closing wire or rope the strands are received by the rotor of the machine from spools installed in stationary spool holders, the spools rotating around their respective axles under the action of the wire being drawn by a take-up mechanism, the rotor rotating around the stationary spool holder. A major problem encountered in designing wire-rope twisting machines is that of fixing the spool holder stationary relative to the rotating rotor effecting the main function in wire-rope making, i.e. twisting. Most of the presently employed machines for wire-rope manufacture use the gravitational systems for fixing the spool holders wherein the center of gravity of the spool holder is offset relative to the axis of rotation of the rotor; that is, the axle of the spool holder does not coincide with the geometrical axis of rotation of the rotor.

In case of jamming of the bearings journalling the rotor and supporting the spool holder, the rotating rotor tends to capture the spool holder. Due to the center of gravity of the spool holder being misaligned relative to the axis of rotation of the rotor, the joint rotation of the rotor with the spool holder gives rise to immense centrifugal forces tending to destroy the machine.

One major aspect of the present invention involves a solution to the above problem in that it makes it possible to align the axle of the spool holder with the geometrical axis of rotation of the rotor. This is effected by the use of an electromagnetic system of fixing the spool holder, which in turn enables location of the rotor and the spool holder vertically. The vertical rotor machine occupies far lesser production floor area than those equipped with the gravitational rotor fixation and horizontally located rotor.

Another aspect of the invention is the use of a single spool holder common for all the spools employed and a single electromagnetic system for fixing the spool holder. This permits a drastic reduction of the overall dimensions of the machine and arrangement within practicably allowable height limits four, six or eight spools on the spool holder, thereby making the machine more versatile in that it can be used for the manufacture of strand, metal cordage or rope.

Still another aspect of the invention is that the vertical wire-rope twisting machine can effect a two-for-one or double twisting of strand for each revolution of the rotor, which doubles the productivity of the machine as compared to the prior art machines.

Accordingly, the rotor is made up of two interconnected end plates, one of the end plates being the driving plate, whereas the other one is driven by means of two light-weight tubular elements provided with inlet and outlet openings for passing the wire to be twisted therethrough, the tubular elements being rotatably supported at midpoint thereof by an intermediate support secured to the carrying plate of the machine.

The moment of inertia of the rotor of such a construction is negligeable. The rotor itself is practically noise-free, and enables an easy access to the spools, which facilitates a more convenient loading and threading of wire resulting in an increased productivity. The wire from the spools is threaded into the tubular element or pipe to pass therealong to the lower end plate of the rotor and further to the upper end plate to enter the rope-forming die, thereby preventing the wire from breakage and improving the reliability of operation.

Alternatively, the end plates can be interconnected by toothed pulleys axially aligned therewith and enclosed by endless belts engaged with a shaft disposed sideways of the rotor in a plane essentially parallel therewith.

From the lower end plate the wire is raised unsupported to the upper plate to enter the rope-forming die. A rotor of this construction affords an even more convenient access to the spools, whereby loading and threading the wire is considerably facilitated and sped up. Machine noise is greatly reduced making such machines more preferable for their multiple operation in production premises lacking partition walls and considerably improving the working conditions for the operators.

The use of the single common spool holder saves space in arranging the spools in one or two rows symmetrically to the rotor axis. In one embodiment according to the invention, the spool braking means consists of rollers rotatable on their respective axles and a pivotable space lever. This makes the braking means brake-pressure sensitive, because as the wire leaves the spool, the wire tension increases due to the reduced radius of the spooled wire. The employment of this pressure- or tension-sensitive braking means permits the twisting of wires of small diameters, since such a braking means acts to automatically maintain a constant wire tension, thus preventing it from breakage.

In another preferred form, the spool braking means is defined by inserts of semicylindrical shape with a preselected friction pair, i.e. the materials having a friction coefficient sufficient to provide a preset tension of the wire to be twisted. This arrangement enables a required braking force to be applied to the spool to tense the wire for the tensed wire to be drawn therefrom. As the wire is being unwound from the spool, the rotational speed of the spool increases, tending to increase the tension imparted to the wire, although this is counteracted by the proportional reduction in the weight of the spool and the accompanying decrease of friction against the inserts, thereby resulting in a stable tension of the wire.

The heretofore described construction of the wire-rope twisting machine provides for reducing the production floor area occupied by the machine, decreasing the mass and the moment of inertia of the rotor, improving the noise performance of the machine and increasing the productivity thereof. The machine according to the invention is easy to operate.

BRIEF DESCRIPTION OF THE INVENTION

The invention will now be described in greater detail with reference to specific embodiments thereof taken in conjunction with the accompanying drawings, in which:

FIG. 1 is a partially sectional, front view of the wire-rope twisting machine according to the invention, wherein rotational movement to the upper end plate of the rotor is imparted by the lower driving end plate, the end plates being coupled together by means of tubular elements or pipes rotatably supported in the medium portion thereof by a bearing support secured to the carrying plate;

FIG. 2 is a partially sectional, front view of the wire-rope twisting machine, wherein rotational movement to the upper end plate of the rotor is imparted by means of toothed pulleys disposed essentially axially relative to the end plates of the rotor and enclosed by endless belts engaged with a shaft located sideways of the rotor in a plane essentially parallel therewith, the spools being arranged in one row;

DETAILED DESCRIPTION OF THE INVENTION

Figure 1:
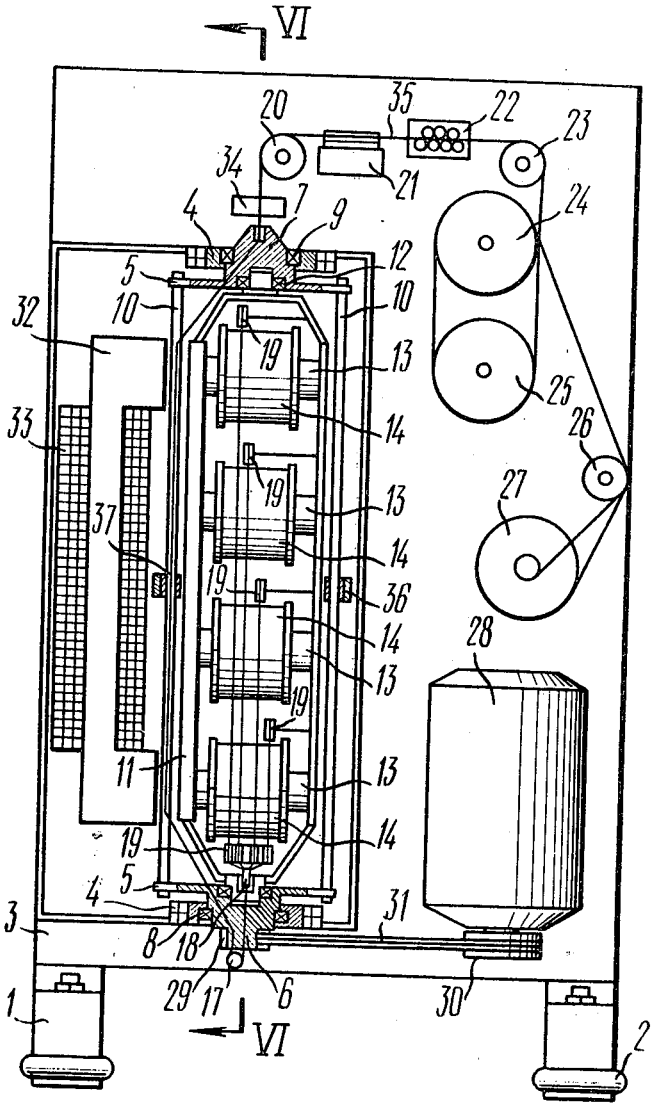
Figure 2:
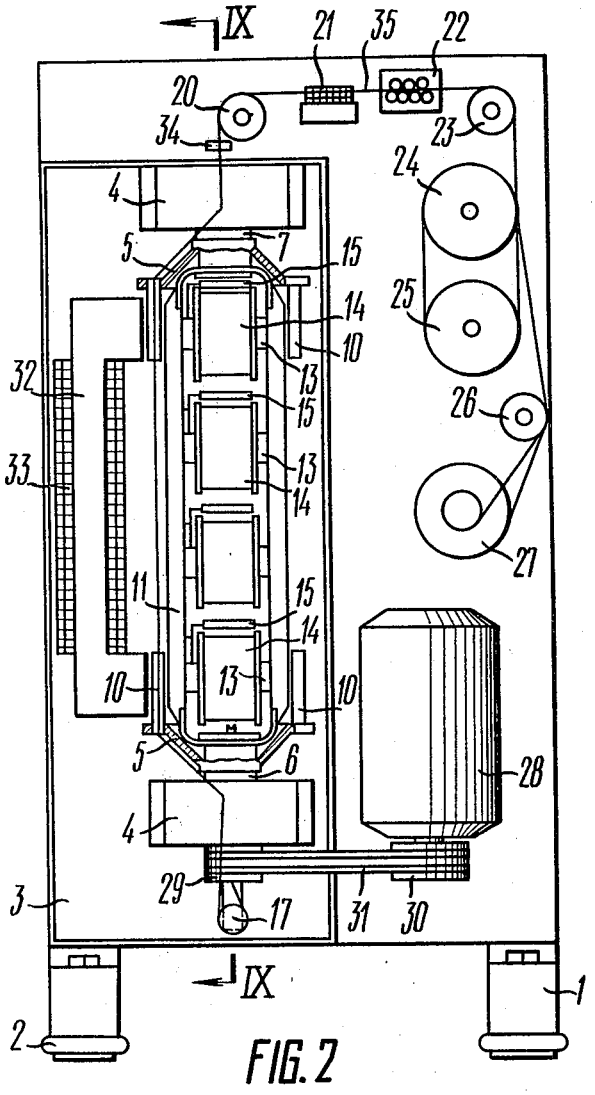
Figure 3:
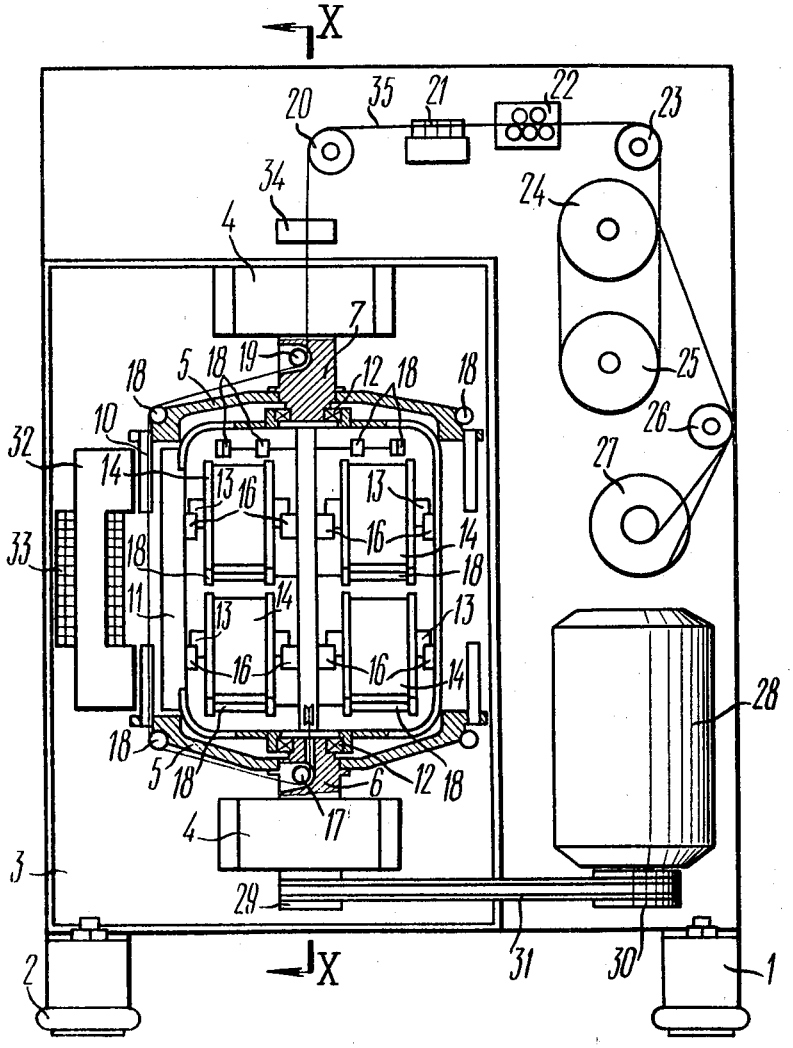
FIG. 3 is a partially sectional, front view of the embodiment of FIG. 2 with the spools arranged in two rows.
Figure 4:
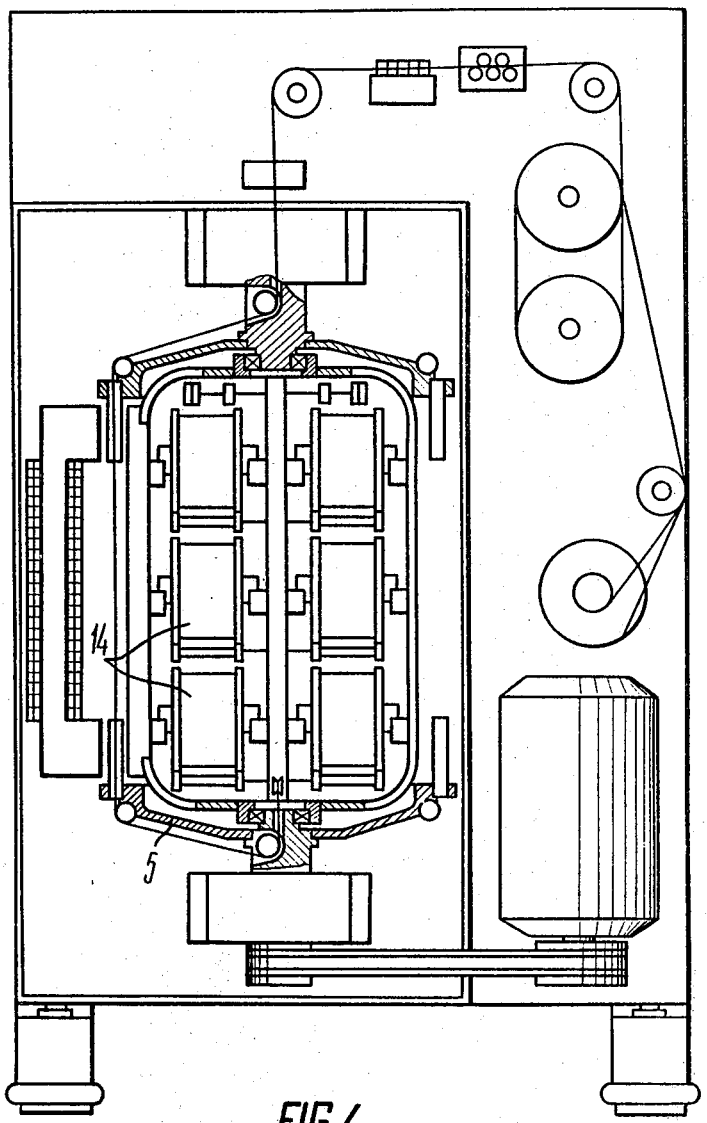
FIG. 4 is a partially sectional, front view of the embodiment of FIG. 2 with six spools.
Figure 5:
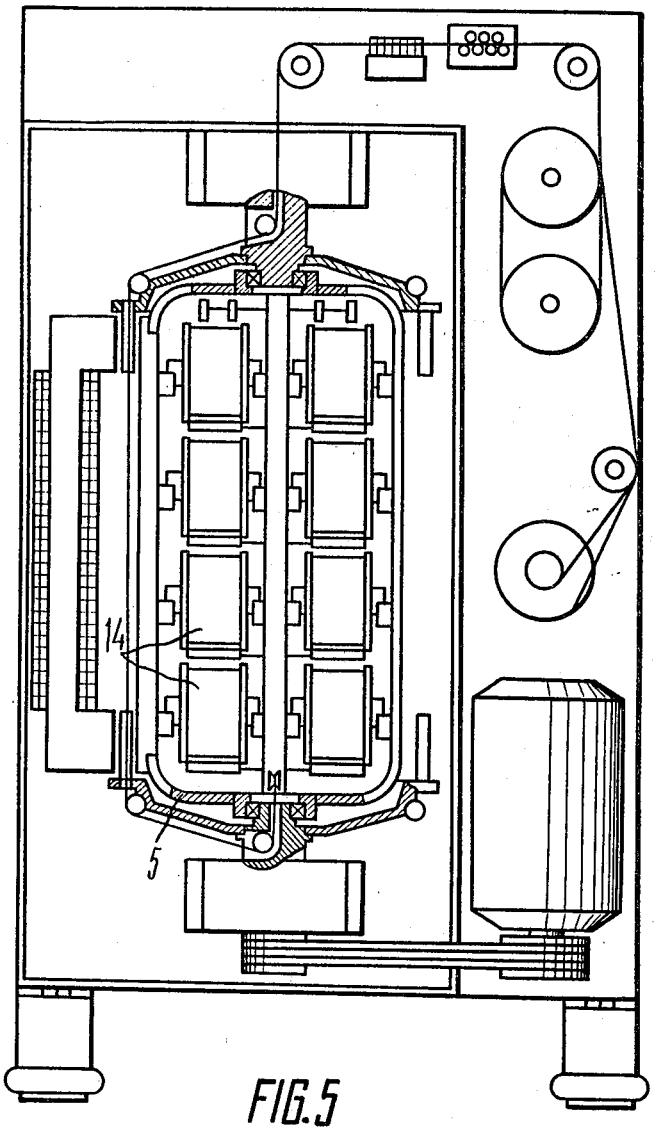
FIG. 5 is a partially sectional, front view of the embodiment of FIG. 2 with eight spools.
Figure 6:
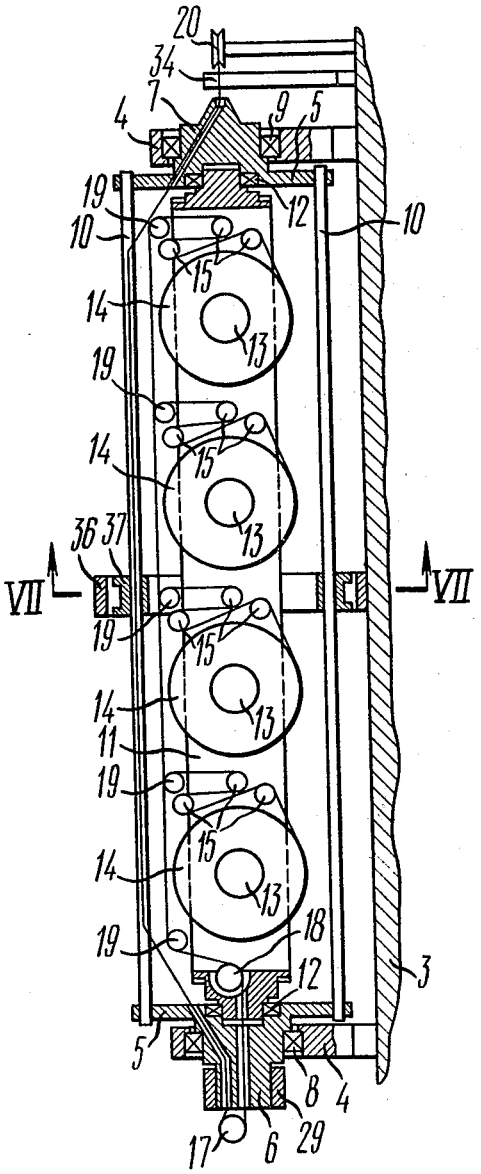
FIG. 6 is a cross-sectional view taken on the line VI—VI of FIG. 1.
Figure 7:
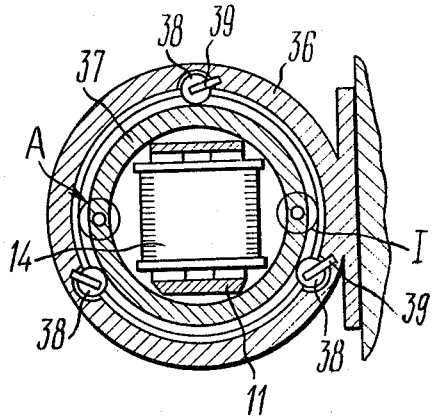
FIG. 7 is a cross-sectional view taken on the line VII—VII of FIG. 6.
Figure 8:
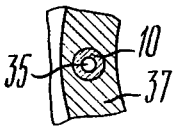
FIG. 8 shows a view in the direction of the arrow A in FIG. 7.
Figure 9:
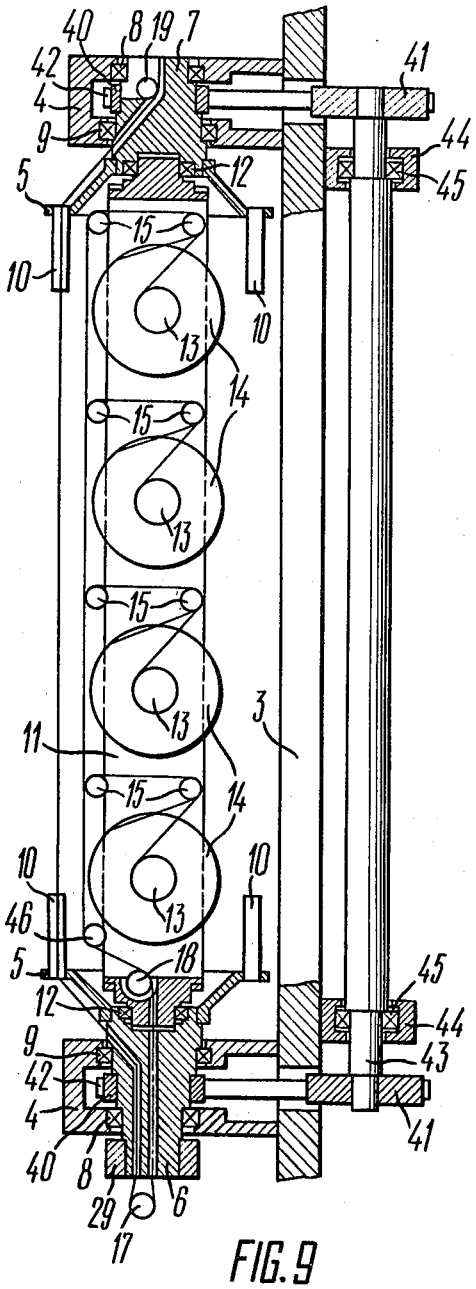
FIG. 9 is a cross-sectional view taken on the line IX—IX of FIG. 2.
Figure 10:
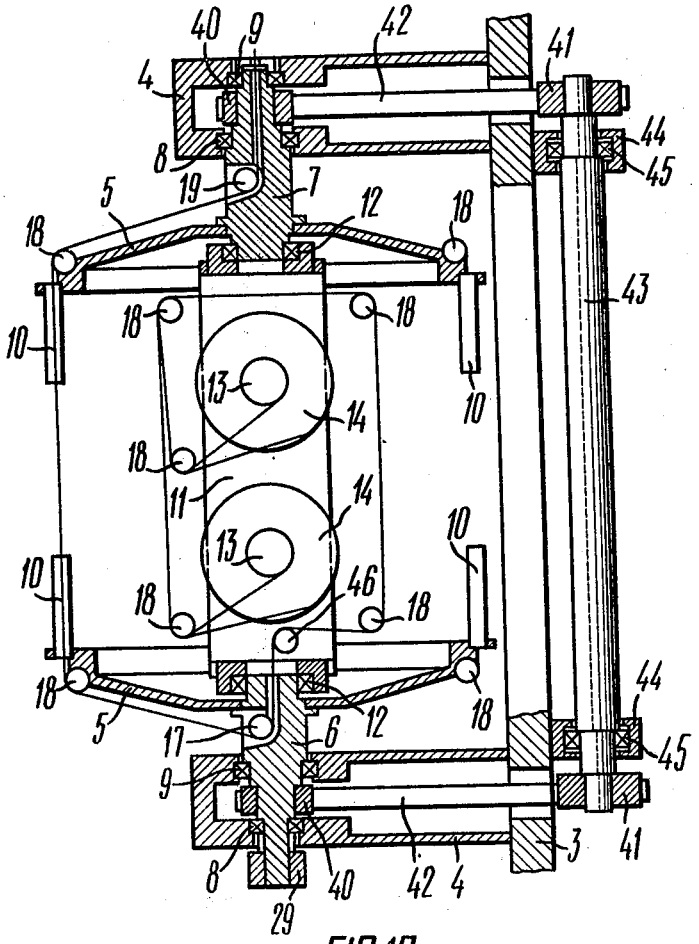
FIG. 10 is a cross-sectional view taken on the line X—X of FIG. 3.

A vertical wire-rope twisting machine (FIGS. 1, 2, 3, 4, 5, 6, 7, 8, 9 and 10) comprises a frame 1 mounted on vibration supports 2. Secured to the frame 1 symmetrically on both sides thereof are carrying plates 3 (represented in the Figures is only a front view of one of the carrying plates; a view of another one of the pair is, similar to the one shown, that is the machine can be doubled). Attached to the carrying plate 3 are bearing supports 4 in which there are secured by means of shafts 6 and 7 and bearings 8 and 9 end plates of a rotor 5. Adapted for rigid attachment with peripheral portions of the end plates of the rotor 5 are tubular elements in the form of connecting pipes 10. A common spool holder 11 is mounted on the axles of the end plates for rotation in bearings 12. The common spool holder 11 accommodates spools 14 rotatably secured on axles 13. Each spool 14 is provided with a braking means generally in the form of rollers 15 and a space lever (not shown) or, alternatively, in the form of inserts 16 (FIGS. 3, 4 and 5) of semicylindrical shape affixed to the spool holder 11, the spools 14 and their respective axles 13 rotating in the inserts 16, the inserts being fabricated from a material having a friction coefficient sufficient to provide a preset tension of the wire or rope being twisted.

Attached to the shaft 6 of the lower end plate of the rotor 5 is a turn roller 17, and the spool holder 11 is provided with guide rollers 18 and 19. Further, the carrying plate 3 comprises a guide roller 20, straightening rollers 21 and 22, a guide roller 23, capstains 24 and 25, a strand placer 26, a take up reel 27 and an electric motor 28. The lower end plate of the rotor 5 is rotatably driven by the electric motor through pulleys 29 and 30 and V-belts 31. The common spool holder 11 is restrained from rotating together with the rotor 5 by a single electromagnetic fixing system comprised of a magnetic circuit 32 and an electrical coil 33. Also mounted on the carrying plate 3 is a strand-forming die 34. The wire received from each of the spools 14 by the rotor 5 is then twisted into a strand 35. The connecting pipes 10 of the rotor 5 (FIGS. 6, 7 and 8) are supported midway of the latter by an intermediate support 36 secured to the carrying plate 3 of the machine. Rotatably secured in the intermediate support 36 is a ring member 37 with the pipes 10 passing therethrough. The ring member 37 is adapted to rotatably cooperate with rollers 38 held fixed to the intermediate support 36 by means of arms 39.

In an embodiment of the vertical wire-rope twisting machine shown in FIGS. 2, 3, 4, 5, 9 and 10 there is provided a drive means for transmitting rotational movement from the lower end plate of the rotor 5 to the upper end plate thereof, said drive means comprising toothed pulleys 40 and 41, belts 42, and a shaft 43 affixed to the inner side of the carrying plate 3 by means of supports 44 and bearings 45.

Secured to the common spool holder 11 is a supporting roller 46.

Prior to starting, the machine is loaded and threaded with wire. To this end, the wire is threaded from the spools 14 via the rollers 15, 19 and 18 onto the turn roller 17, from which along drillings provided in the shaft 6 and the lower plate of the rotor 5 it is then caused to pass further upwards along the pipe 10 and drillings provided in the upper end plate of the rotor 5, shaft 7, forming die 34, guide roller 20, straightening rollers 21 and 22, guide roller 23, capstains 24 and 25, and strand placer 26 to be received by the take up reel 27 thereby making the machine ready for operation.

Rotational movement is imparted to the lower end plate of the rotor 5 by the electric motor 28 via the pulleys 29 and 30, V-belts 31 and the shaft 6. Rotation of the rotor 5 is accompanied by the capstains 24 and 25 causing to draw the wire along the thread paths, a first twist of the wire occuring between the rollers 18 and 17, a second twist taking place between the rollers 19 and 20, all within one revolution of the rotor, thus increasing the production efficiency of the machine twofold.

The tension reels 24 and 25, as well as the strand placer 26 and the take up reel 27 are rotated by the electric motor 28 coupled therewith by means of a worm-gear reducer and chain transmissions (not shown) located on the opposite side of the carrying plate 3.

In the course of rotation and taking up the strand, the take up reel 27 is caused to slip due to the provision of a friction or clutch mechanism arranged on the opposite side of the carrying plate 3 (not shown).

The machine according to the invention may be provided with a means for obtaining a dead strand or cord.

What is claimed is:

1. A vertical wire-rope twisting machine comprising:

a carrying plate;

a rotor mounted in supports secured to said carrying plate and having a vertical axis of rotation, said rotor including at least two interconnected end plates journaled in bearings;

a drive for one of said end plates;

spools provided with braking means and wire to be twisted;

a single spool holder common for all the spools and journaled in bearings inside said rotor, the axis of rotation of the spool holder coinciding with the axis of rotation of the rotor; and an electromagnetic system for fixing said spool holder.

2. A machine as claimed in claim 1, wherein the end plates are interconnected by tubular elements having at the surface thereof inlet and outlet openings for passing therethrough the wire to be twisted and rotatably secured at a median point thereof by an intermediate support affixed to the carrying plate of the machine.

3. A machine as claimed in claim 1, wherein the end plates are interconnected by toothed pulleys disposed axially relative to the end plates and enclosed by endless belts to cooperate with a shaft located sideways of and essentially parallel with the rotor.

4. A machine as claimed in claim 1, wherein the spool holder has the form of a space frame with the spools thereof arranged in one row, the braking means thereof incorporating rollers and a space lever.

5. A machine as claimed in claim 1, wherein the spool holder has the form of a space frame with the spools thereof arranged in two rows essentially in symmetry with the axis of the end plates, the braking means of the spools comprising inserts of semicylindrical shape secured to the spool holder and fabricated from a material having a friction coefficient capable of providing a preset tension to the wire to be twisted.

* * * * *